United States Patent [19]

Couture

[11] 4,106,723

[45] Aug. 15, 1978

[54] SPOOL FOR THREAD OR THE LIKE

[75] Inventor: Paul A. Couture, Stroudsburg, Pa.

[73] Assignee: Holland Thread Co., Stroudsburg, Pa.

[21] Appl. No.: 828,134

[22] Filed: Aug. 26, 1977

[51] Int. Cl.[2] ..... B65H 75/12; B65H 49/36

[52] U.S. Cl. ..... 242/118.3; 242/118.4; 242/130; 242/134; 242/139

[58] Field of Search ..... 242/118.4, 118.3, 118.31, 242/118.32, 130, 118.7, 134, 139, 1, 118.41, 141, 118.8, 77, 118, 125

[56] References Cited

U.S. PATENT DOCUMENTS

| | | | |
|---|---|---|---|
| 2,347,376 | 4/1944 | Steinhilber | 242/118.32 |
| 3,176,932 | 4/1965 | Kovaleski | 242/118.41 X |

FOREIGN PATENT DOCUMENTS

| | | | |
|---|---|---|---|
| 527,159 | 10/1940 | United Kingdom | 242/118.32 |
| 795,485 | 5/1958 | United Kingdom | 242/118.3 |

*Primary Examiner*—George F. Mautz

*Attorney, Agent, or Firm*—Michael F. Petock

[57] ABSTRACT

A spool for thread or the like is provided with means for locking or securing the spool in position over a spindle. The spool may be of the type having a base member and a substantially cylindrical portion in which the thread may be taken from the spool in a direction substantially parallel to the spool axis. A locking means is provided to prevent spool jumping when the thread on the spool is partially removed making the spool with the remaining thread thereon lighter. In one embodiment, radial score marks, indentations or grooves are formed in a thin membrane section of the spool formed across the bore of the spool. The spool is designed so that the thin membrane will break along the radial score marks when placed over the spindle with the inwardly pointing ends of the thin membrane engaging the spindle thereby holding the spool down. In another embodiment, an adhesive is provided on the bottom of the base portion of the spool to temporarily fasten the spool to the thread stand plate.

9 Claims, 6 Drawing Figures

FIG. 1
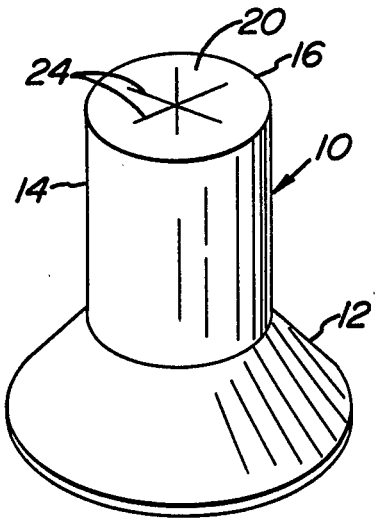
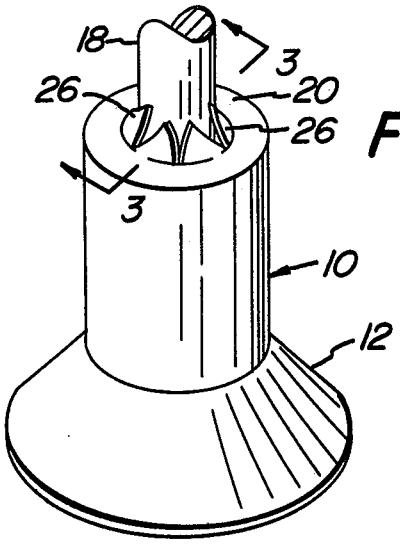
FIG. 2
FIG. 3
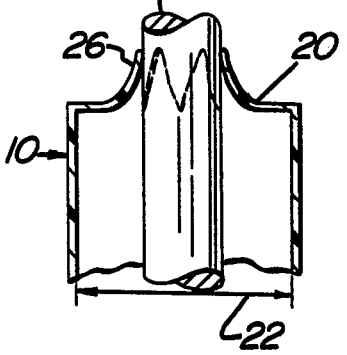
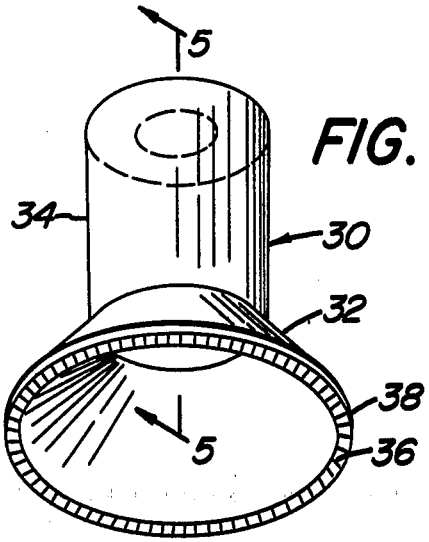
FIG. 4
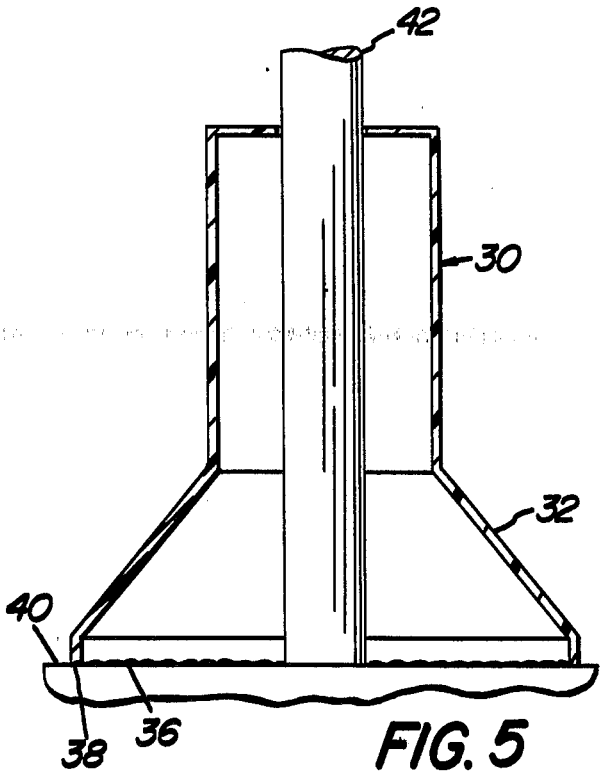
FIG. 5
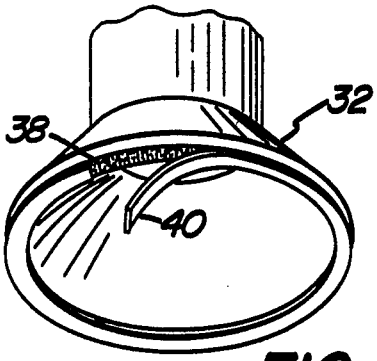
FIG. 6

SPOOL FOR THREAD OR THE LIKE

BACKGROUND OF THE INVENTION

The present invention relates to spools for holding thread or the like. More particularly, the present invention relates to spools for holding thread in which a means is provided for retaining the spool of thread in place on the thread stand over the spindle.

The present invention is primarily directed to spools for thread or the like which may be used to hold sewing thread and which may be used in conjunction with sewing machines. These spools may be comprised of a flared base member and a vertically extending cylindrical member around which the thread is wound in a conventional manner. These spools are sometimes referred to as single head spools. In use, the spools are placed on a thread stand over a spindle or rod and do not rotate. The thread is drawn from the spool vertically or substantially parallel to the axis of the spool over the small end and goes directly to the sewing machine via thread guides.

In the past, there has been a problem with plastic spools and to some extent with wooden spools used to hold industrial sewing thread for use in the sewing trade. When the thread on the spool is partially removed in use, but before the spool is completely empty of thread, the spool with the thread becomes lighter and has a tendency to jump up on the spindle due to momentary hang ups of thread passing over the courses of thread still on the spool. The jumping of the spool causes increased tension in the thread which may sometimes result in skipped stitches and possible broken thread at the needle of the sewing machine.

SUMMARY OF THE INVENTION

The present invention provides means for eliminating the jumping of spools on the spindle during use thereby resulting in smoother feeding of the thread to the sewing machine.

In accordance with one embodiment of the present invention, a membrane is provided across the bore hole of the spool. The membrane may be provided at any point along the bore, but preferrably may be provided at the end of the cylindrical member opposite the base. The thin member is provided with radial score marks. When the spool is placed over the spindle, the membrane breaks at the score marks causing the inwardly projecting portions of the membrane to engage the spindle.

In accordance with another embodiment of the present invention, adhesive is applied to the outer end of the base member whereby the spool may be adhesively temporarily fastened to a thread stand plate of the sewing machine. The adhesive may be provided on a knurled, grooved or roughened surface to enhance adhesion of the glue to the surface. The glue may be provided between a removable member, such as a label, and the outer end of the base member.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of one embodiment of a spool in accordance with the present invention.

FIG. 2 is a view in perspective of the spool of FIG. 1 mounted on a spindle in accordance with the present invention.

FIG. 3 is a view in cross-section taken along line 3—3 of FIG. 2.

FIG. 4 is a view in perspective of another embodiment of the present invention.

FIG. 5 is a cross-sectional view taken along line 5—5 of FIG. 4 showing the spool as mounted on a thread stand plate.

FIG. 6 is a view in perspective of a spool illustrating a removable member having adhesive thereon.

DETAILED DESCRIPTION OF THE PREFERRED EMBODIMENTS

Referring now to the drawings in detail, wherein like numerals indicate like elements, there is shown in FIG. 1 a spool 10 for holding thread in accordance with the present invention. The spool is comprised of a base member 12 and a substantially cylindrical portion 14. The base member 12 may be flared downwardly and outwardly as shown in FIG. 1, and which is conventional in the trade. The thread (not shown) is wound on spool 10 over substantially cylindrical member 14 and flared base member 12 to the extent of flaring as is conventional. In use, the thread is drawn from spool 10 upwardly and substantially vertically from the spool. In other words, the thread is drawn from the spool over ths small end 16 of spool 10 and in a direction substantially parallel to the axis of spool 10. The axis of the spool 10 may be considered to be the center line of the bore of spool 10 or the center line of spindle 18 as shown in FIG. 2.

In use, the spool is placed on a thread stand over a spindle. The spool does not rotate. In the past, as the thread was drawn vertically off of the spool over the small end, there was a tendency for the spool to be periodically lifted from the thread stand plate due to momentary hang ups of the thread passing over the courses of thread still on the spool. The problem became more severe as more and more thread was drawn from the spool due to the decrease in weight of the combined spool and thread.

The present invention provides means for retaining the spool in position on the thread stand thereby eliminating what is sometimes referred to as "jumping of the spool" and resulting in smoother feeding of thread to the sewing machine.

The spool 10 is provided with a member 20 mounted across the bore or inner diameter 22 of spool 10 as shown in FIGS. 1, 2 and 3. Member 20 may be preferrably mounted at small end 16 as shown in FIGS. 1, 2 & 3. However, it is understood that member 20 may be mounted at any position along the axis of spool 10. In other words, member 20 may be formed inside of spool 10 at any point along the axis, inside of substantially cylindrical member 14 or flared base 12.

Member 20 may be a thin membrane embossed or molded with radial score marks 24. The score marks are formed of sufficient depth in member 20 so that member 20 breaks along the score marks when spool 10 is mounted over spindle 18 as shown in FIG. 2. The mounting of spool 10 over spindle 18 forms a plurality of radially inwardly projecting portions 26 of member 20 as shown in FIGS. 2 and 3. Spool 10 and member 20 may be comprised of any suitable material such as a synthetic plastic having a predetermined flexibility. The composition of spool 10 may preferrably be a thermoplastic material such as polypropylene, polyethylene and other suitable thermoplastic materials.

Referring now to FIGS. 4, 5 and 6, there is shown another embodiment of the present invention comprised of a spool 30 having a flared base 32 and a substantially cylindrical portion 34. The thread is wound on spool 30 in a manner similar to that of spool 10. Spool 30 is provided with an adhesive 36 on the outer end 38 of flared base 32. The outer end 38 of flared base 32 is provided with a knurled, grooved or roughened surface to enhance the holding ability of the adhesive.

In use, the spool 30 is mounted on a thread stand plate 40 over a spindle 42. The adhesive 36 on roughened end 38 temporarily fastens the outer end 38 of base 32 of spool 30 to thread stand plate 40. The adhesive 36 forms a sufficiently strong bond to hold spool 30 securely to thread stand plate 40 during normal use of the spool of thread in a sewing machine. However, a firm pull on the spool 30 will remove it from the thread stand plate.

The adhesive 36 may be preferrably applied to the spool during manufacture. The adhesive may be protected from unwanted fastening and maintained on end 38 of spool 30 by a removable member 40. The removable member 40 may be a strip as shown in FIG. 6 or a label which covers the entire outer end of base 32. The label may conventionally contain information as to the type of thread on the spool. Alternatively, the adhesive may be applied immediately prior to use of the spool in the sewing machine. The adhesive may be any suitable type of adhesive.

It is understood that the adhesive mounting structure disclosed in FIGS. 4, 5 and 6 may be used in conjunction with the radial retaining means structure of FIGS. 1, 2 and 3, and may preferrably be so used. However, it is understood that either retaining means may be used independently.

The present invention may be embodied in other specific forms without departing from the spirit or essential attributes thereof and, accordingly, reference should be made to the appended claims, rather than to the foregoing specification as indicating the scope of the invention.

What is claimed is:

1. A spool for holding thread, said spool comprising:

a base and a substantially cylindrical portion with a bore passing therethrough, said spool being mountable over a spindle with said spindle passing through said spool bore; and means for retaining said spool on said spindle, said means comprising a radially scored member mounted across said bore whereby said member breaks along said score lines when the spool is placed over the spindle causing radially inwardly projecting portions of said member to engage said spindle thereby holding said spool on said spindle.

2. A spool in accordance with claim 1 wherein said radially scored member is mounted at the end of said bore opposite the base.

3. A spool in accordance with claim 1 wherein said base is provided with an adhesive applied to its outer end whereby said spool may be temporarily adhesively bonded to a thread stand plate.

4. A spool in accordance with claim 3 wherein said outer end of said base is knurled, grooved or roughened to enhance the holding ability of the adhesive.

5. A spool in accordance with claim 3 wherein said spool is provided with a removable member having adhesive between said removable member and the outer end of said base whereby said removable member may be removed leaving adhesive on the outer end of said base for fastening to the thread stand plate.

6. A spool for holding thread, said spool comprising:

a substantially cylindrical portion connected with a flared base, said spool having a bore therethrough and being mountable over a spindle;

means for retaining said spool on said spindle comprising adhesive applied to the outer end of said flared base whereby said spool may be adhesively temporarily fastened to a thread stand plate; and a removable member with said adhesive between said removable member and the outer end of said flared base whereby said removable member may be removed leaving adhesive on the outer end of said flared member for fastening to the thread stand plate.

7. A spool in accordance with claim 6 wherein said outer end of said flared base is knurled, grooved or roughened to enhance the holding ability of the adhesive.

8. A spool in accordance with claim 6 including means comprising a radially scored member mounted across said bore of said substantially cylindrical portion of said spool whereby said member breaks along said score lines when the spool is placed over the spindle causing radially inwardly projecting portions of said member to engage said spindle thereby holding said spool on said spindle.

9. A spool in accordance with claim 8 wherein said radially scored member is mounted at the end of said bore opposite said flared base.

* * * * *